US005579696A

United States Patent [19]

Berg

[11] Patent Number: 5,579,696

[45] Date of Patent: Dec. 3, 1996

[54] RAIL CAR SIDE FRAME CAR PROGRESSOR CONTACT

[75] Inventor: Thomas R. Berg, Clarendon Hills, Ill.

[73] Assignee: Standard Research and Design Corporation, Park Ridge, Ill.

[21] Appl. No.: 526,205

[22] Filed: Sep. 11, 1995

[51] Int. Cl.[6] ..... B61F 5/00

[52] U.S. Cl. ..... 105/206.1; 105/182.1

[58] Field of Search ..... 105/182.1, 206.1, 105/206.2, 209, 229, 165, 167, 168; 104/162

[56] References Cited

U.S. PATENT DOCUMENTS

| | | | |
|---|---|---|---|
| 2,097,579 | 11/1937 | Symington | 105/206.1 |
| 2,170,123 | 8/1939 | Busch | 105/206.1 |
| 2,222,484 | 11/1940 | Light | 105/206.1 |
| 2,393,046 | 1/1946 | Keller | 105/206.2 |
| 4,870,914 | 10/1989 | Radwill | 105/206.2 |
| 5,461,986 | 10/1995 | Sarnicki et al. | 105/165 |

FOREIGN PATENT DOCUMENTS

| | | | |
|---|---|---|---|
| 1729870 | 4/1992 | U.S.S.R. | 105/206.1 |

*Primary Examiner*—Mark T. Le

*Attorney, Agent, or Firm*—Dorn, McEachran, Jambor & Keating

[57] ABSTRACT

A rail car truck side frame has an upper compression member and a lower tension member, with these members being joined by integral end walls which slant upwardly and outwardly from the tension member toward the compression member. To protect the side frame from the elements of car progressors, there is a car progressor contact extending forwardly from the lower outward portion of each end wall of the side frame. The contact is formed and adapted to be contacted by and protect the side frame from the pusher of a car progressor. The car progressor contact may either be cast into the side frame or it may be a separate welded element. When the side frame is used in a frame brace truck, the car progressor contact may extend outwardly from the bracket which is attached to the side frame and supports the cross braces of the truck.

3 Claims, 4 Drawing Sheets

RAIL CAR SIDE FRAME CAR PROGRESSOR CONTACT

THE FIELD OF THE INVENTION

It is now common practice in the railroad industry to use car progressors to move strings of rail cars such as hopper cars, tank cars, and other bulk handling rail cars in areas where it may be unsafe to use a locomotive. Strings of such cars, with up to 25 or more cars per string, can be moved into position at speeds of up to 50 ft. per minute.

Typically, the car progressor contacts the lower portion of the side frame adjacent the Junction of the side frame tension member and the end wall which extends up to the side frame compression member. The present invention is concerned with providing a contact area to prevent damage to the side frames from the car progressor pusher elements. The side frame of the present invention also includes a sloping bridge, behind the car progressor contact, which prevents elements of the car progressor from snapping up too rapidly and catching onto the side frame.

The car progressor contact means, which includes both the car progressor contact element extending forwardly from the end wall and the bridge which is between the end wall and the car progressor contact, may be integral with or separate elements welded to the side frame. The invention is described in connection with frame brace trucks having diagonal cross braces between opposite corners of the side frame. As such, the car progressor contact means are attached to the brackets which support the cross braces. The invention should not be so limited and has wide application to any type of side frame used in conventional rail cars.

SUMMARY OF THE INVENTION

The present invention relates to side frames for rail car trucks and particularly to car progressor contacts to protect the side frames from wear and structural damage occasioned by the use of car progressors in moving rail cars.

A primary purpose of the invention is car progressor contact means suitable for use on frame brace trucks to protect the brackets mounting the frame brace cross struts.

Another purpose is a car progressor contact for the use described which is integral with the cast steel side frame.

Another purpose is a car progressor contact means for the use described which consists of separate elements welded to the side frame.

Another purpose is a car progressor contact means for the use described which includes a forwardly extending contact element and a bridge element behind the contact element and suitable to provide for gradual rising of portions of the car progressor moving elements.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Car progressors manufactured by such companies as Stephens-Adamson, Pittsburgh, Pa., DS Industrial and Marine, Webb Lake, Wis., and Motion Controls, Inc., Minneapolis, Minn., are used to move strings of rail cars in areas where it is neither practical nor safe for locomotives. The car progressors are designed to move rail cars in strings of up to 25 or more cars at speeds of up to 50 ft. per minute. The car progressors include a pusher dog and means for controlling dog vertical position, either mechanically or hydraulically. The pusher dog provides car movement and the means for controlling dog vertical position positioning the pusher dog to permit the entire assembly to perform its intended function.

The contact between the elements of the car progressor and the side frame can cause wear and structural damage to the end wall of the side frame. This is particularly troublesome in frame brace trucks in which the lower corners of the side frame have brackets which support the cross struts for the frame brace truck. The present invention is particularly concerned with car progressor contacts to protect the side frame brackets of frame brace trucks, but the concepts disclosed herein are equally applicable to any type of side frame.

Figure 1:
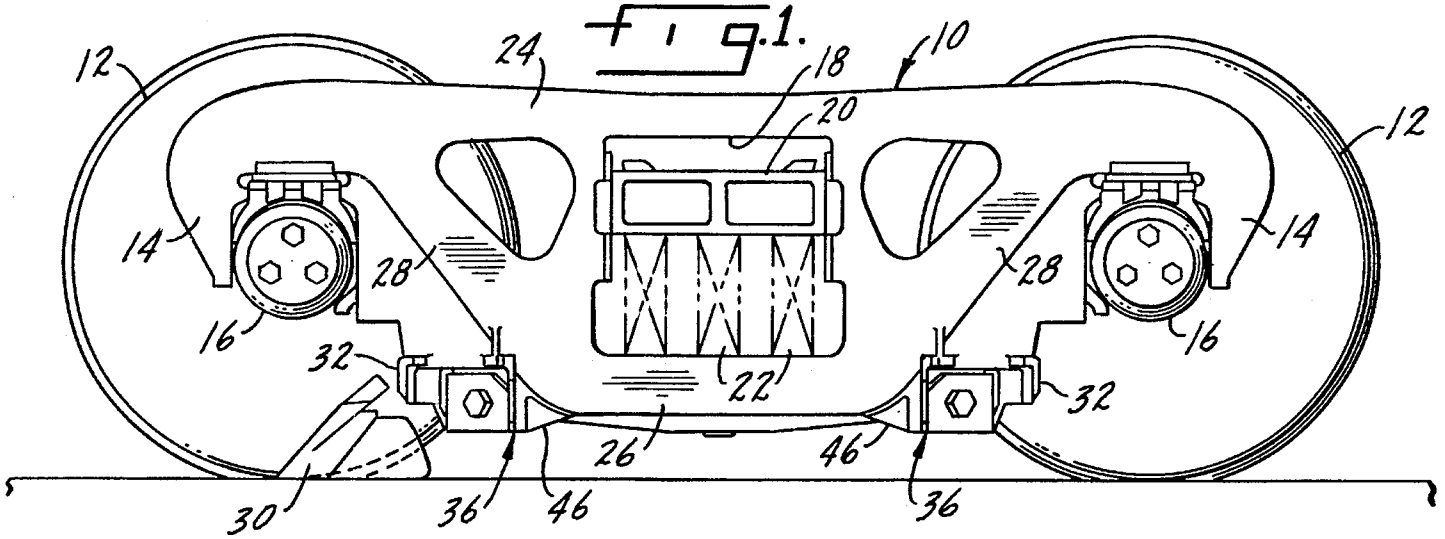
FIG. 1 is a side view of a rail car truck showing the side frame of the present invention.

In FIG. 1, a rail car truck is shown to include a side frame 10 supported on wheels 12. The side frame has pedestals 14 which seat upon the roller bearings 16 forming part of the wheelsets. The side frame 10 has a window 18 within which is positioned a bolster 20 supported by spring sets 22.

The side frame 10, as is conventional, includes an upper compression member 24 and a lower tension member 26. The side frame is an integral cast steel element and the compression member and tension member are joined by end walls 28 which slant upwardly and outwardly from the tension member to the compression member.

Also illustrated in FIG. 1 is the pusher dog 30 of a car progressor which is shown in position adjacent a contact element 32 which extends outwardly from the end wall 28.

Figure 2:
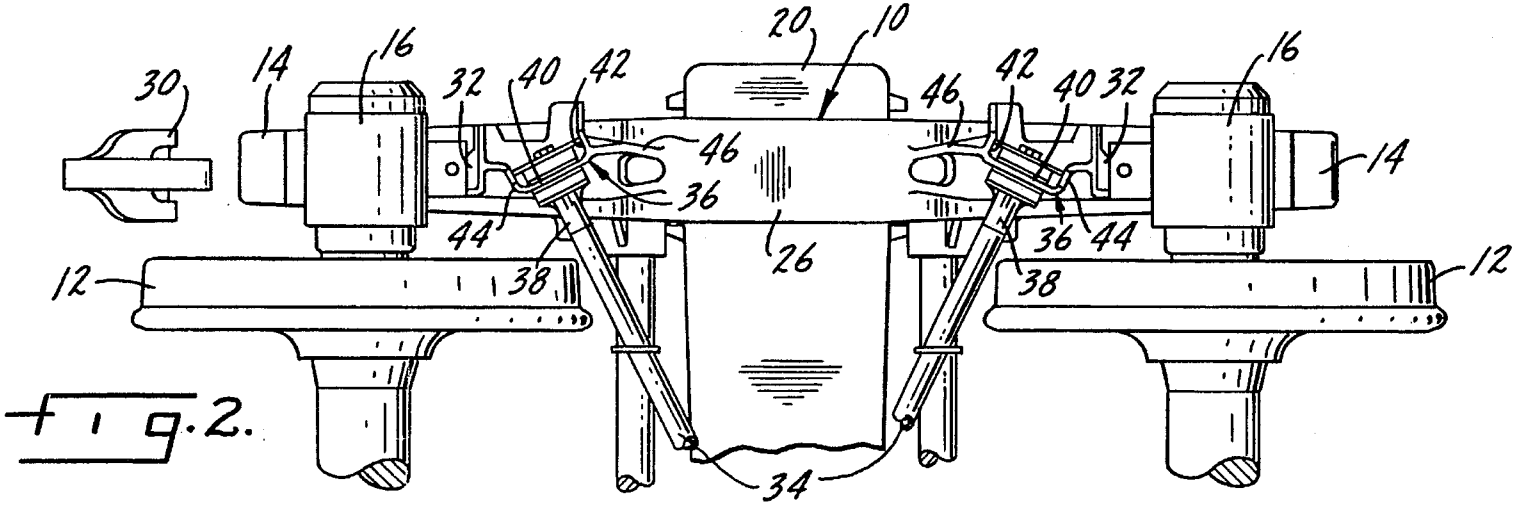
FIG. 2 is a bottom view of the side frame and rail car truck of FIG. 1.

As shown particularly in FIG. 2, the frame brace truck includes cross struts 34 which are mounted in brackets 36 by what is known as an end block 38. U.S. Pat. Nos. 4,570,544 and 5,243,920 show typical details of frame brace rail car construction and the disclosures of these patents are herein incorporated by reference.

As shown in FIGS. 1 and 2, the bracket 36 supporting the end block 38 is cast integral with the side frame and is shown to be generally U-shaped in configuration and has a wall 40 and two side walls 42 and 44. The end block is bolt mounted to the wall 40. Extending from end wall 42 toward the tension member 26 and slanting upwardly from the end wall 42 to the tension member, as shown in FIG. 1, is a bridge element 46. The bridge element is effective to permit portions of the car progressor to gradually lower after passage beneath the lower tension member 26 so that the car progressor elements do not abruptly rise and catch on the bracket 36, but rather pass beneath as the side frame passes over the car progressor.

At the forward end of bracket 36 and attached to end wall 44 is the car contact 32. This again is cast with the side frame as is the bridge element 46. The car progressor contact 32 is positioned to contact the dog 30 as particularly shown in FIG. 1. The dog 30 will be in contact with the car progressor contact 32 to move the car truck shown in FIG. 1 to the right. The contact 32 protects the side frame from damage from the dog 30 and in particular protects the bracket 36 which supports the cross strut 34 from any kind of wear or damage from the car progressor dog 30. Note that the bracket 36 extends beneath the level of the tension member 26 and that the bridge 46 extends upwardly from beneath the tension member to Join it generally at the Junction between the tension member and the end wall 28. The side frame is symmetrical in that there are brackets 36, car progressor contacts 32, and bridges 46 at both sides of the side frame or extending outwardly from both of the end walls 28 of the integrally cast steel side frame.

Figure 3:
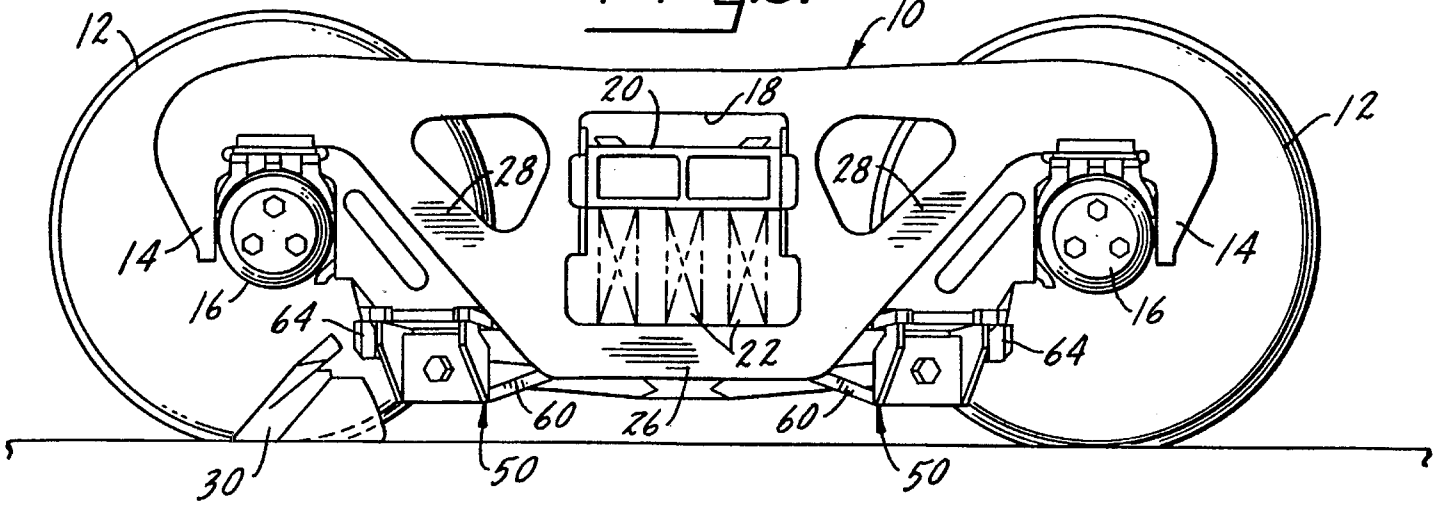
FIG. 3 is a side view, similar to FIG. 1, showing a second embodiment of the invention.
Figure 4:
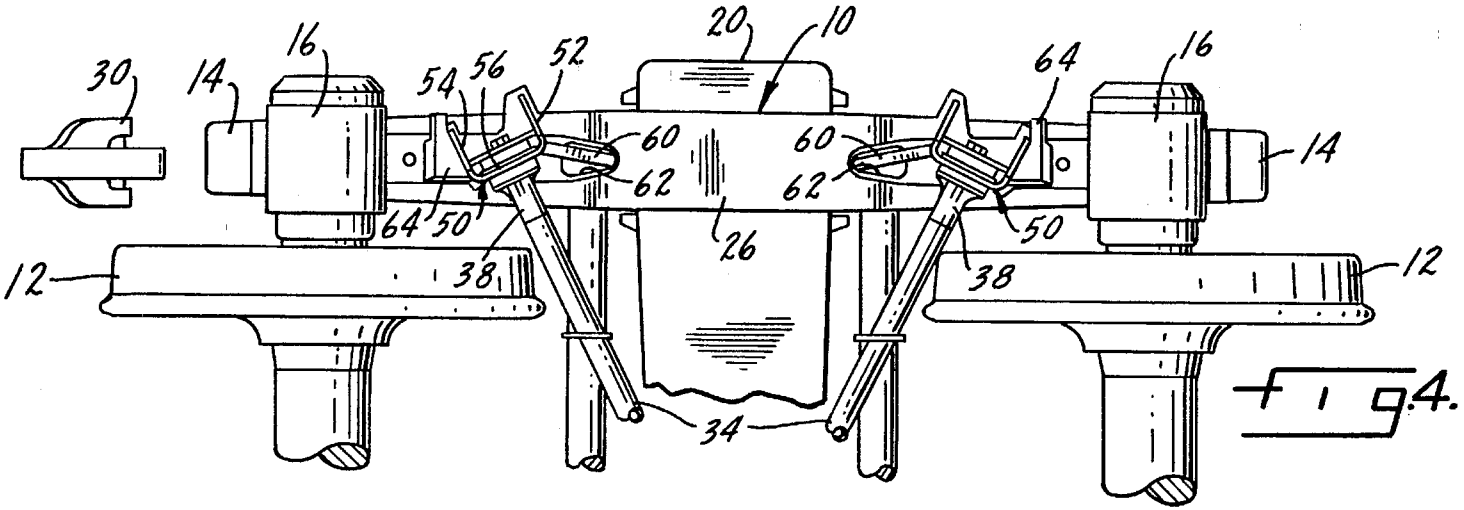
FIG. 4 is a bottom view of the side frame and rail car truck of FIG. 3.

In the construction of FIGS. 3 and 4, like elements have been given identical numbers. The principal difference between the FIG. 3 and 4 construction and the side frame of FIGS. 1 and 2, is that the brackets 50 which support the cross struts 34 are not cast integral with the side frame but are separate elements welded to the side frame. Bracket 50, as shown particularly in FIGS. 3 and 4, is again generally U-shaped and has side walls 52 and 54 and an end wall 56 to which the end block 38 is attached. The bridge to support the rear of the bracket and to provide for the gradual release of car progressor elements is indicated at 60 and will be welded at one end to the corner of walls 52 and 56, and will then extend through a bottom opening 62 in the side frame and be welded to the side frame. The bridge 60 in the FIG. 3 and 4 embodiment performs the same function as the bridge 46 in the FIG. 1 and 2 embodiment.

Figure 5:
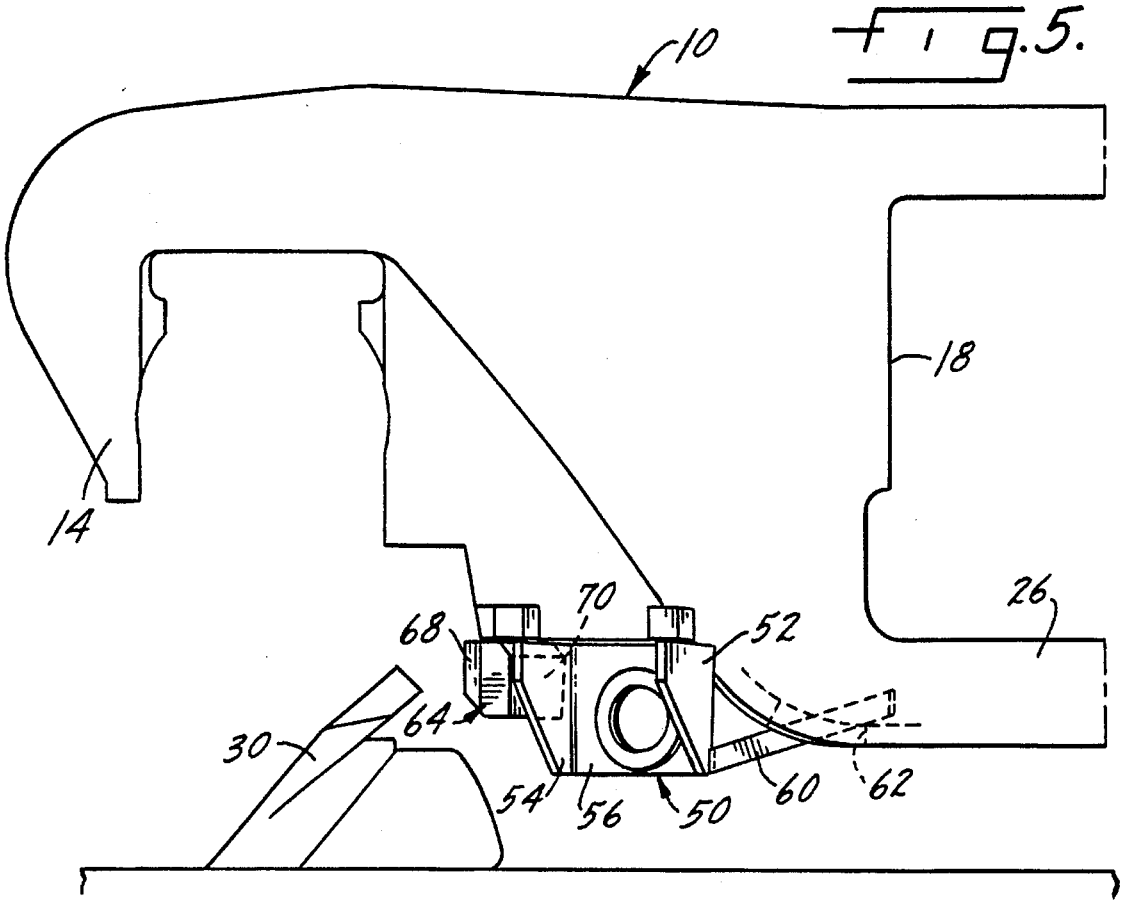
FIG. 5 is an enlarged side view of an end of the side frame of FIG. 4, illustrating in detail the car progressor contact and related elements.
Figure 6:
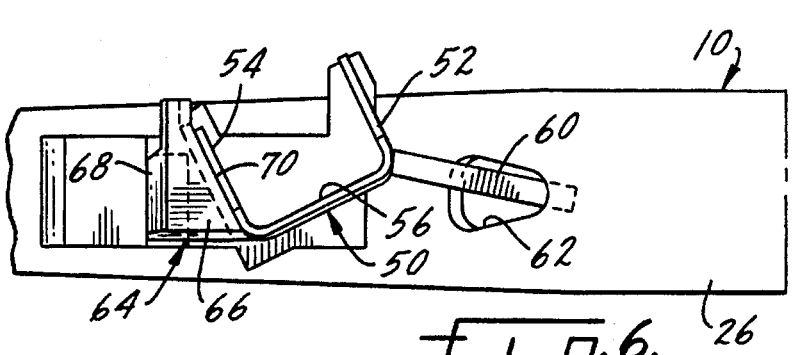
FIG. 6 is a bottom view of the side frame of FIG. 5.
Figure 7:
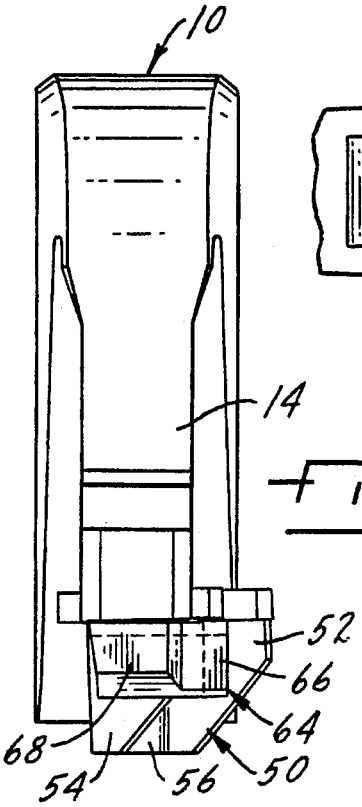
FIG. 7 is an end view of the side frame of FIGS. 5 and 6.
Figure 8:
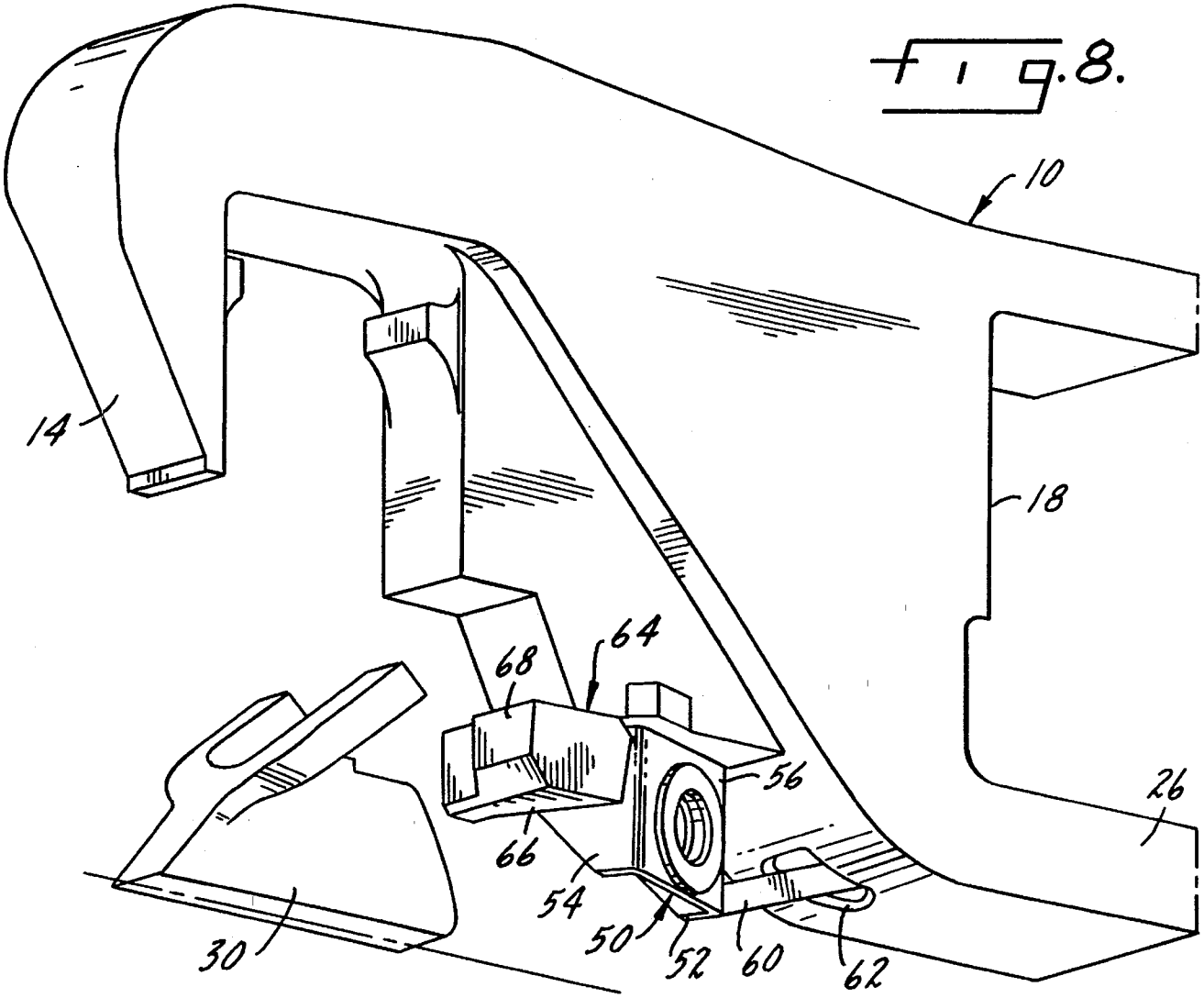
FIG. 8 is an underside perspective of a portion of the side frame and car progressor contact and related elements of the embodiment of FIG. 3.

Just forward of wall 54 of bracket 50 is the car progressor contact 64. This is shown in more specific detail in FIGS. 6 and 7. The car progressor contact 64 has a wedge-shaped portion 66 and a forward, somewhat slanted wall 68 which is positioned to contact the car progressor dog 30 as shown in FIG. 5. There is a rear surface 70 which will be welded to the wall 54 so that the contact 64 will provide the desired protection for the bracket 50 and prevent any wear or damage to the bracket or to the side frame.

As indicated above, the car progressor contact and the bridge element are particularly advantageous with frame brace trucks. These same elements may be attached to side frames of conventional trucks which do not use the cross struts to provide truck stability. Thus, the invention broadly has application to any three-piece truck construction in which the side frame has an area to be contacted by car progressor elements and there is the potential for wear and damage to the side frame from such contact.

Whereas the preferred form of the invention has been shown and described herein, it should be realized that there may be many modifications, substitutions and alterations thereto.

The embodiments of the invention in which an exclusive property or privilege is claimed are defined as follows:

1. A frame brace rail car truck side frame including an upper compression member and a lower tension member, said compression and tension members being joined by integral end walls which slant upwardly and outwardly from the lower tension member toward the compression member, each end wall having generally U-shaped bracket means for the mounting of a cross brace, car progressor contact means, including a car progressor contact which extends outwardly from the lower outward portion of each end wall and forwardly of said bracket means, a bridge which extends from said bracket means upwardly toward the tension member, with said bridge extending from one side of said generally U-shaped bracket means and said contact extending from the other side of said generally U-shaped bracket means, said car progressor contact means being formed and adapted to be contacted by a pusher of a car progressor and function to protect the side frame end walls from such contact.

2. The side frame of claim 1 wherein said bracket means, contact, and bridge are all cast integral with the side frame.

3. The side frame of claim 1 wherein said bracket means, contact, and bridge are all independent elements welded to the side frame.

* * * * *